US006623375B2

(12) United States Patent
Davies

(10) Patent No.: US 6,623,375 B2
(45) Date of Patent: Sep. 23, 2003

(54) GOLF CLUB

(76) Inventor: Laurence W. Davies, 18 Stronsay Place, Winnipeg, Manitoba (CA), R2G 2Y3

( * ) Notice: Subject to any disclaimer, the term of this patent is extended or adjusted under 35 U.S.C. 154(b) by 0 days.

(21) Appl. No.: 10/201,637

(22) Filed: Jul. 23, 2002

(65) Prior Publication Data

US 2003/0032496 A1 Feb. 13, 2003

Related U.S. Application Data

(60) Provisional application No. 60/306,848, filed on Jul. 23, 2001.

(51) Int. Cl.[7] ..... A63B 53/04
(52) U.S. Cl. ..... 473/314; 327/328; 327/349
(58) Field of Search ..... 473/313, 314, 473/324, 327, 328, 349, 345, 340

(56) References Cited

U.S. PATENT DOCUMENTS

| | | | | |
|---|---|---|---|---|
| 3,204,962 A | | 9/1965 | McCormick | |
| 5,160,141 A | * | 11/1992 | Crews | 473/313 |
| 5,199,707 A | | 4/1993 | Knox | |
| 5,338,029 A | | 8/1994 | Falzone | |
| 5,458,335 A | | 10/1995 | Hattori | |
| 5,494,288 A | | 2/1996 | Jimenez et al. | |
| 5,544,879 A | | 8/1996 | Collins | |
| 5,624,329 A | | 4/1997 | Schneebeli | |
| 5,827,130 A | | 10/1998 | Jimenez et al. | |
| 5,855,524 A | | 1/1999 | Jenkins | |
| 5,989,132 A | | 11/1999 | MacDonald et al. | |
| 6,050,903 A | * | 4/2000 | Lake | 473/244 |
| 6,190,267 B1 | | 2/2001 | Marlowe et al. | |
| 6,319,148 B1 | * | 11/2001 | Tom | 473/290 |
| 6,497,626 B1 | * | 12/2002 | Sundberg | 473/248 |

* cited by examiner

*Primary Examiner*—Stephen Blau
(74) *Attorney, Agent, or Firm*—Adrian D. Battison; Michael R. Williams; Ryan W. Dupuis

(57) ABSTRACT

A golf club iron has a club head having a generally planar generally rectangular front face for impacting a ball with a horizontal top edge and a horizontal bottom edge. The front face is symmetrical about an imaginary upright center line at right angles to a transverse line and equidistant between the sides so that the upright center line and the transverse center line intersect at an imaginary center point of the front face. The club head defines an imaginary horizontal center line at right angles to the transverse line passing through the imaginary center point of the front face and substantially through the center of gravity of the head. A tubular shaft hosel is integrally attached to the rear face of the club head with an axis of the tubular hosel at the club head coaxial with the axis of the shaft. The hosel is arranged so that the axis of the shaft and the hosel intersects the imaginary horizontal center line at a position reward of the center of gravity.

8 Claims, 5 Drawing Sheets

GOLF CLUB

This application claims the benefit of Provisional Application No. 60/306,848 filed Jul. 23, 2001.

This invention relates to an improved golf club.

BACKGROUND OF THE INVENTION

Prior clubs in which the shaft is moved forward toward the center of gravity of the club are shown in the following U.S. Patents.

| | | |
|---|---|---|
| 5,855,524 | Jenkins | Jan. 5, 1999 |
| 5,827,130 | Jimenez et al. | Oct. 27, 1998 |
| 5,544,879 | Collins | Aug. 13, 1996 |
| 6,190,267 | Marlowe et al. | Feb. 20, 2001 |
| 5,494,288 | Jimenez et al. | Feb. 27, 1996 |
| 5,458,335 | Hattori | Oct. 17, 1995 |
| 3,204,962 | McCormick | Sep. 7, 1965 |
| 5,338,029 | Schneebeli | Apr. 29, 1997 |
| 5,199,707 | Knox | Apr. 6, 1993 |
| 5,338,029 | Falzone | Aug. 16, 1994 |
| 5,989,132 | MacDonald | Nov. 23, 1999 |

However none of these provides a simple effective club with the advantages of the club of the present invention.

SUMMARY OF THE INVENTION

It is one object of the present invention to provide an improved golf club.

According to a first aspect of the invention there is provided a golf club iron comprising:

a club head having a generally planar front face for impacting a ball, a rear face opposite to the front face, two sides, a top surface and a bottom surface;

the front face defining a horizontal top edge at the top surface and a horizontal bottom edge at the bottom surface;

the front face having an imaginary transverse line lying in the plane of the front face across the width of the face equidistant between the top and bottom edges;

the front face being symmetrical about an imaginary upright center line at right angles to the transverse line and equidistant between the sides so that the upright center line and the transverse center line intersect at an imaginary center point of the front face;

the club head defining an imaginary horizontal center line at right angles to the transverse line passing through the imaginary center point of the front face;

a tubular shaft hosel integrally attached to the rear face of the club head so that a front side of the hosel is integral with the rear face and supports the club head in front of the hosel;

a shaft attached to the hosel so that an axis of the tubular hosel at the club head is coaxial with an axis of the shaft;

the hosel being arranged on the club head so that the shaft extends at an angle less than ninety degrees to the transverse line which angle is arranged so that the club is intended to be swung in an iron driving action to cause impact;

the front face lying in a plane at an angle to a vertical plane containing the transverse line so as to provide a loft angle for driving the ball during impact;

the club head being shaped such that a center of gravity thereof lies substantially on said imaginary horizontal center line rearwardly of the front face;

the hosel being arranged so that the axis of the shaft and the hosel intersect the imaginary horizontal center line at a position reward of the center of gravity.

Preferably the angle of the shaft to the transverse line is less than 70 degrees.

Preferably the front face has a bottom edge which includes a central straight portion.

Preferably the front face has a top edge which includes a central straight portion.

Preferably the front face has ball engaging grooves parallel to the transverse line covering substantially the whole of the front face.

Preferably the club head is substantially triangular in side elevation with the front face and the rear face converging to the top surface which is narrower than the bottom surface.

Preferably the front face has side edges at the sides of the head each of which includes a straight portion intersecting the transverse line.

Preferably the straight portion of each side edge is connected to the bottom edge by a bottom curved section and to the top edge by a top curved section and wherein the bottom curved section has a greater radius of curvature than the top curved section.

The club provides the one or more of following features which are new and novel:

1) in view of the symmetrical location of the axis of the shaft which intersects the horizontal center line, this acts to minimize or eliminate club head twist at high and full swing speeds (60 to 130 mph.) caused by:
   a) air friction on down swing
   b) contact with grass or sand prior to contact with ball
   c) head snap or twist at ball contact
2) the axis of shaft to intersecting the center line which contains or substantially contains the club head center of gravity provides most efficient transfer of energy (like a baseball bat).
3) The club face is balanced in both in weight and surface area about the center line so as to provide a balanced or symmetrical impact surface for both air flow and ball impact.

These three features should give better distance and ball control.

For each degree that the club head is off of perpendicular to the ball on contact, the ball travels approximately 0.628" off course per yard of travel i.e. a 100 yard shot would be approximately 20 yards off track, or causes a slice or hook by spinning the ball.

Heal and toe shots are common terms used if the ball does not hit the sweet spot. With this club design there is a maximized sweet spot because the club is nearly 100% balanced. This is a balanced head design that is not triangular.

These clubs may not conform with PGA rules for club design. Manufacturers have made club heads larger and with perimeter weighting to make golf clubs have a larger "sweet spot" and make them more forgiving.

The drawings described hereinafter show designs for a 3 and 7 iron as typical examples, where:

a typical 3 iron has 19 to 20 degrees of loft; and a typical 7 iron has 34 to 36 degrees of loft.

The intention is to provide all standard degrees of loft from a 1 to 9 iron as well as a pitching wedge, sand wedge and a lob wedge, that is, up to 65 degrees.

U.S. Pat. No. 5,855,524 includes data relating to the angles (table 1) for standard lie and loft angles, to which reference is made for further details in this regard.

BRIEF DESCRIPTION OF THE DRAWINGS

One embodiment of the invention will now be described in conjunction with the accompanying drawings in which.

DETAILED DESCRIPTION

Figure 1:
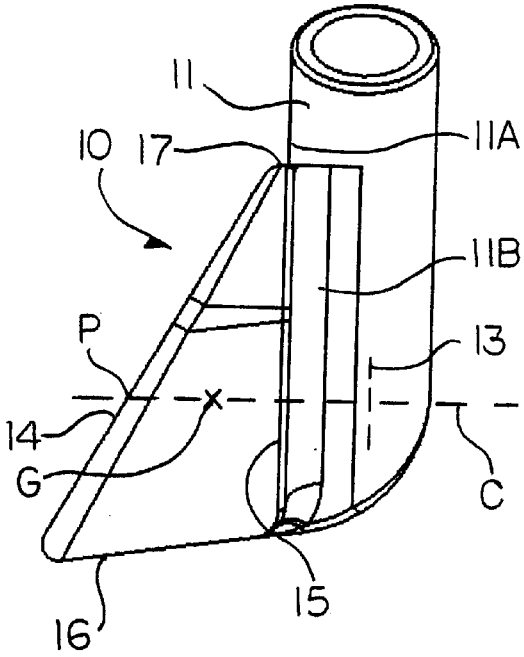
FIG. 1 is a side elevational view of one example of a golf club head according to the present invention showing the various points of interest of the club.
Figure 2:
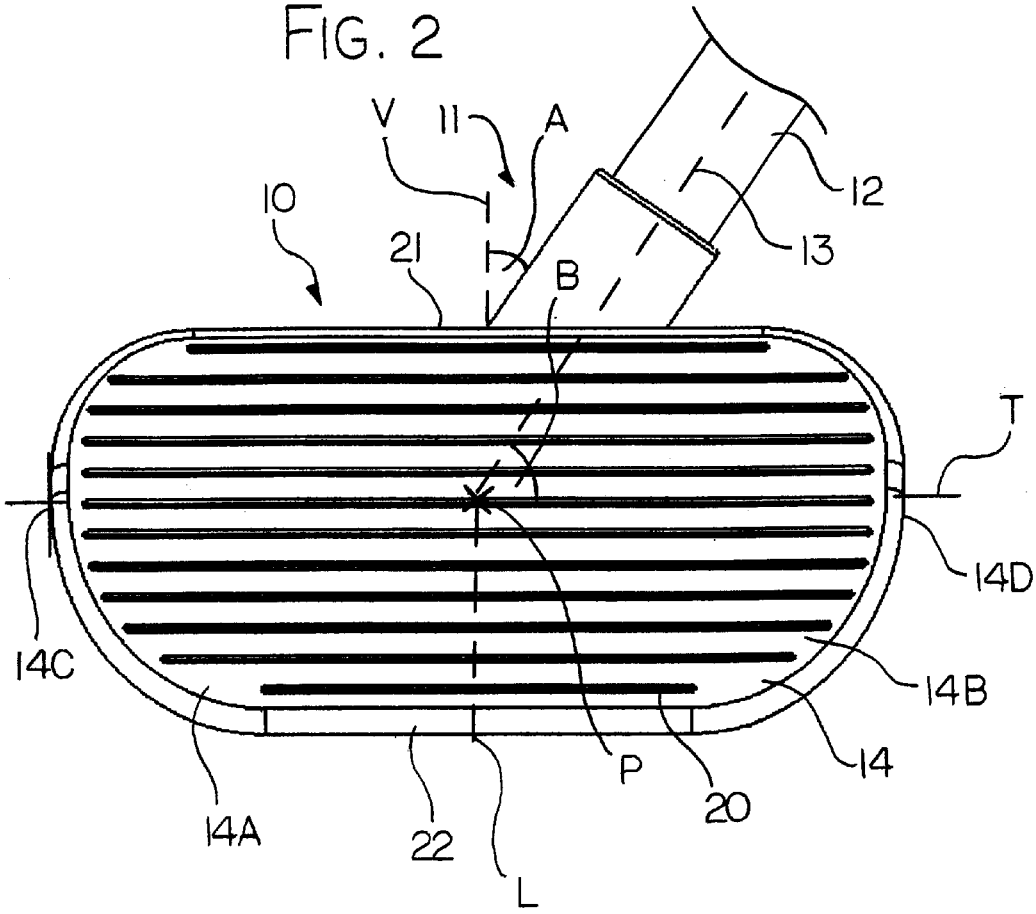
FIG. 2 is a front elevational view of the example of a golf club head shown in FIG. 1.

In FIGS. 1 and 2 is shown a golf club having a club head 10, a hosel 11 and a shaft 12. The shaft 12 has a center line 13. The hosel is a tubular body having a center line which is coincident with the center line 13 so that the shaft extends into the hosel and its centre line continues along the center line of the hosel.

The club head 10 includes a front face 14 and a rear face 15. The club head is generally triangular in shape so that it includes a flat bottom surface 16 and converges upwardly to a top apex 17 defining a line or narrow surface transversely across the top of the club head. The hosel 11 is attached to the rear face 15 so that one side 11A of the hosel lies against the rear face and is attached thereto by filler pieces 11B. In the embodiment shown in FIG. 1 the side face of the hosel lies flat against the rear face so that the hosel continues as a tube through to the bottom of the rear face. In other embodiments where the angle of the rear face rearwardly and downwardly relative to a vertical plane is increased, the hosel decreases in width from the top toward the bottom as shown in the embodiment of FIGS. 3 to 8.

Figure 3:
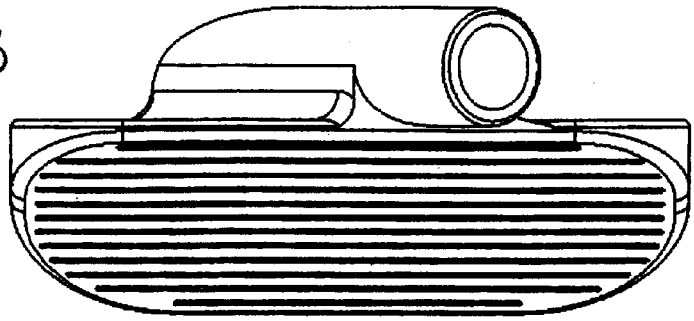
FIGS. 3 to 8 shows six views of one example of iron according to the present invention and particularly a top plan view, isometric view from the front and one side, isometric view from the rear and one side, front elevational view, side elevational view and rear elevational view respectively.
Figure 4:
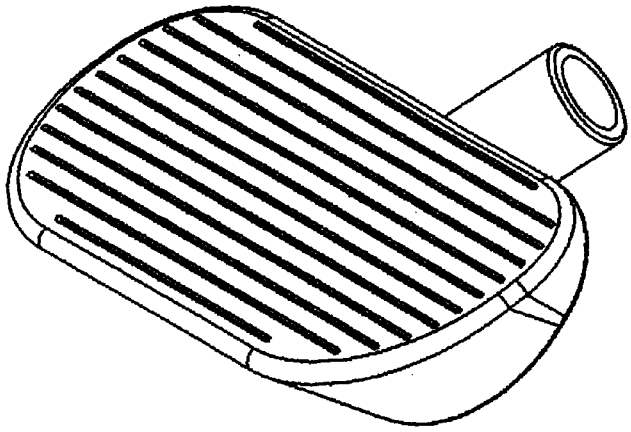
Figure 5:
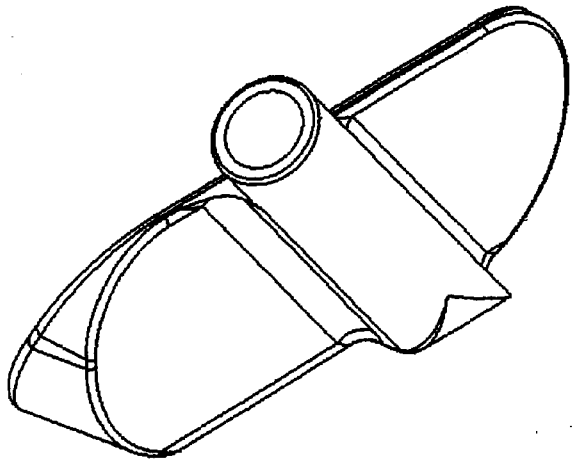
Figure 6:
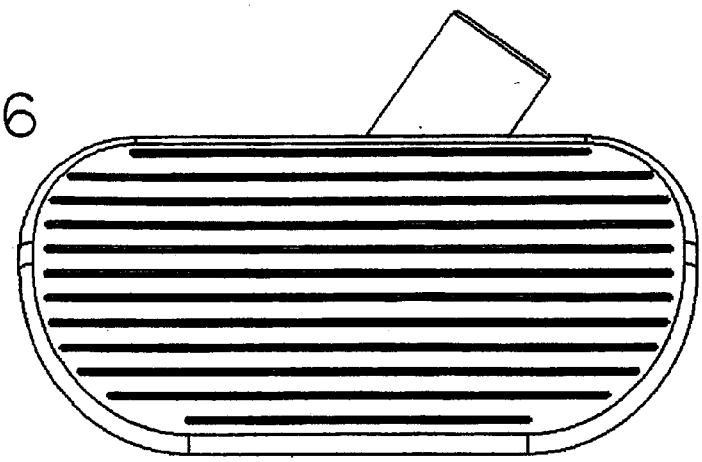
Figure 7:
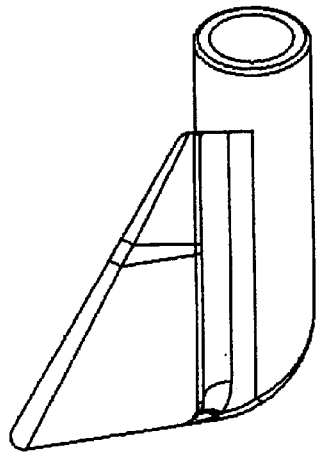
Figure 8:
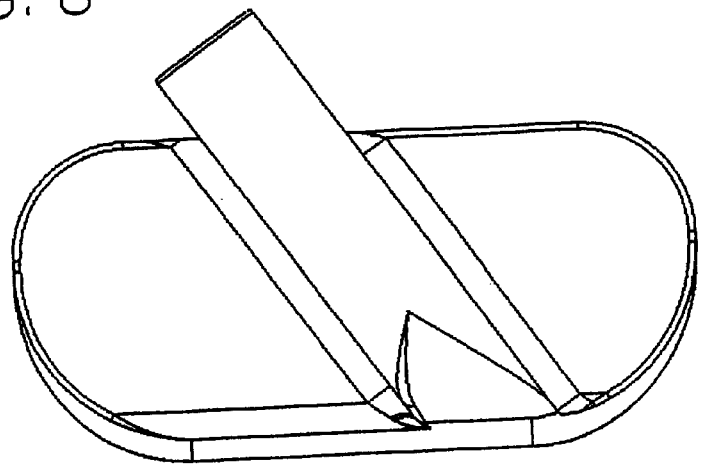
Figure 9:
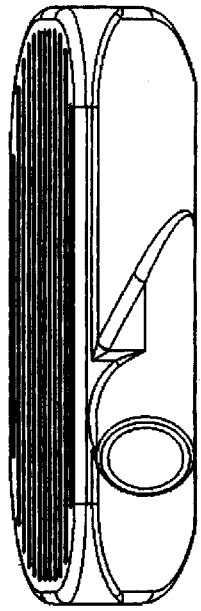
FIGS. 9 to 14 shows six views of a second example of iron according to the present invention and particularly a top plan view, isometric view from the front and one side, isometric view from the rear and one side, front elevational view, side elevational view and rear elevational view respectively.
Figure 10:
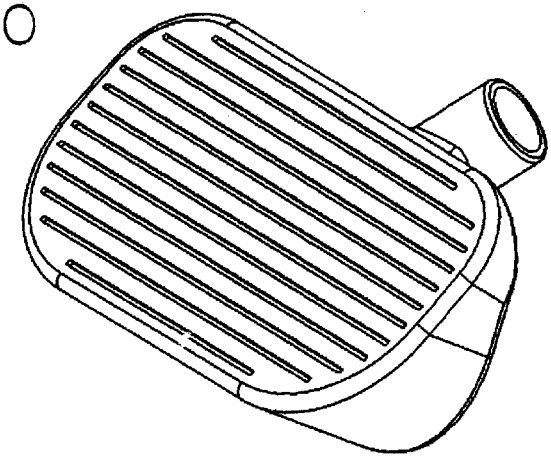
Figure 11:
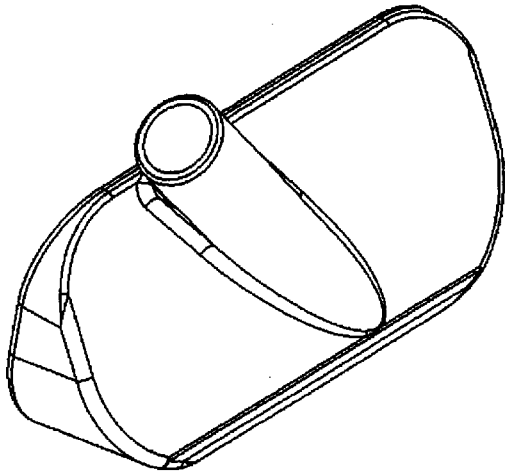
Figure 12:
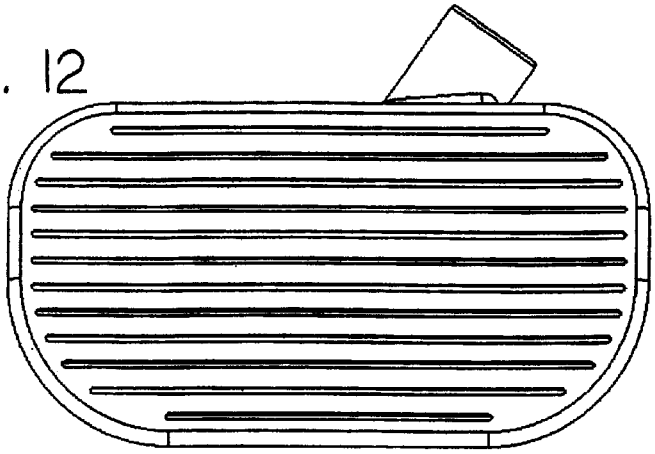
Figure 13:
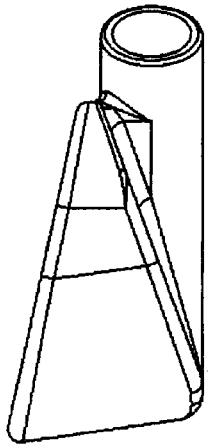
Figure 14:
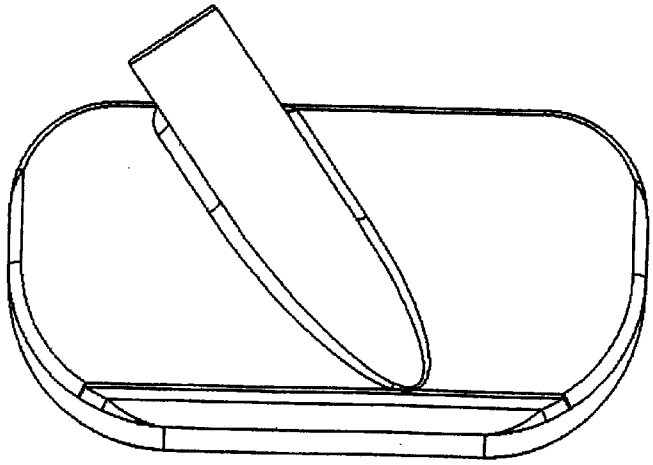

The club head includes a center of gravity G. An imaginary center line C extends rearwardly from the center of gravity so that in an impact position as shown in FIG. 3 the line C is generally horizontal. The front face 14 includes a transverse line T which extends across the width of the front face again as an imaginary line with the intention that the line T is also horizontal in the impact position of the club head.

The center line 13 of the shaft is arranged by the position of the hosel relative to the rear face 15 so that it intersects with the center line C at a position rearward of the center of gravity G as shown in FIG. 1.

Thus the front face 14 defines an outer portion 14A and an inner portion 14B where the outer portion 14A is outward of the center of gravity and the inner portion 14B is inward of the center of gravity. These portions are substantially symmetrical so that they have a similar distance from the center of gravity G to the side edge 14C and 14D.

Thus the line C intersects the front face at a center point P thereof which is formed by the imaginary intersection between the imaginary center line L and the imaginary transverse line T. The center point P lies on the same center line C as the center of gravity approximately although the center of gravity may be slightly below this line depending upon the weight of the hosel relative to the club head and with width of the club head at the bottom surface. However the club is designed so that the center of gravity, the line C and the point P are substantially coincident since this provides the advantageous symmetrical location of both the center of gravity and the center of the front face relative to the axis of the shaft.

The front face 14 includes ball engaging grooves 20 over the full face so they extend from the top edge 21 of the front face to the bottom edge 22 of the front face. The grooves also extend between the side edges 14C and 14D. Thus the whole of the front face can act as an impact surface and there is little difference in effect whether the ball is impacted on the center line C or outwardly or inwardly of the center line.

The hosel 11 is arranged relative to a central vertical place V of the club head so that is defines an angle A relative to the vertical V and an angle B relative to the transverse line T. The angle A is greater than 20 degrees so that the lie angle B is less than 70 degrees and this angle is selected so that it provides the same angle as would be used in a conventional iron or driver so that the user can effect a conventional stroke which will move the head at a speed of the order of 60 to 120 miles per hour in a driving action. Thus the present club is not intended as a putter or a chipper but is intended to replace the conventional iron or driver with the significant forces involved in the driving action.

A top edge 21 includes a flat section and also the bottom edge 22 includes a flat section extending over a significant part of the width of those edges. outside of the flat sections, the side edges 14C and 14D include straight center sections and join to the top and bottom by curved portions with the radius of curvature being slightly less in the upper part above the mid height of the club face than below the mid height.

The arrangement of the symmetrical face allows the face to provided a very large impact area which can be as large as 3.125 inches wide by 1.75 inches high. In order to reduce the total weight and to locate the center of gravity at the center line, the width of the bottom surface can be reduced requiring the hosel to include a wider portion at its bottom at the bottom surface.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A golf club iron comprising:

a club head having a generally planar front face for impacting a ball, a rear face opposite to the front face, two sides, a top surface and a bottom surface;

the front face defining a horizontal top edge at the top surface and a horizontal bottom edge at the bottom surface;

the front face having an imaginary transverse line lying in the plane of the front face across the width of the face equidistant between the top and bottom edges;

the front face being symmetrical about an imaginary upright center line at right angles to the transverse line and equidistant between the sides so that the upright center line and the transverse center line intersect at an imaginary center point of the front face;

the club head defining an imaginary horizontal center line at right angles to the transverse line passing through the imaginary center point of the front face;

a tubular shaft hosel integrally attached to the rear face of the club head so that a front side of the hosel is integral with the rear face and supports the club head in front of the hosel;

a shaft attached to the hosel so that an axis of the tubular hosel at the club head is coaxial with an axis of the shaft;

the hosel being arranged on the club head so that the shaft extends at an angle less than ninety degrees to the transverse line which angle is arranged so that the club is intended to be swung in an iron driving action to cause impact;

the front face lying in a plane at an angle to a vertical plane containing the transverse line so as to provide a loft angle for driving the ball during impact;

the club head being shaped such that a center of gravity thereof lies substantially on said imaginary horizontal center line rearwardly of the front face;

the hosel being arranged so that the axis of the shaft and the hosel intersect the imaginary horizontal center line at a position reward of the center of gravity.

2. The golf club according to claim 1 wherein the angle of the shaft to the transverse line is less than 70 degrees.

3. The golf club according to claim 1 wherein the front face has a bottom edge which includes a central straight portion.

4. The golf club according to claim 1 wherein the front face has a top edge which includes a central straight portion.

5. The golf club according to claim 1 wherein the front face has ball engaging grooves parallel to the transverse line covering substantially the whole of the front face.

6. The golf club according to claim 1 wherein the club head is substantially triangular in side elevation with the front face and the rear face converging to the top surface which is narrower than the bottom surface.

7. The golf club according to claim 1 wherein the front face has side edges at the sides of the head each of which includes a straight portion intersecting the transverse line.

8. The golf club according to claim 7 wherein the straight portion of each side edge is connected to the bottom edge by a bottom curved section and to the top edge by a top curved section and wherein the bottom curved section has a greater radius of curvature than the top curved section.

* * * * *